US007901155B2

(12) United States Patent
Metzger

(10) Patent No.: US 7,901,155 B2
(45) Date of Patent: Mar. 8, 2011

(54) VEHICLE BARRIER

(75) Inventor: John C. Metzger, Lockport, NY (US)

(73) Assignee: Taylor Devices, Inc., North Tonawanda, NY (US)

( * ) Notice: Subject to any disclaimer, the term of this patent is extended or adjusted under 35 U.S.C. 154(b) by 0 days.

(21) Appl. No.: 12/658,490

(22) Filed: Feb. 11, 2010

(65) Prior Publication Data

US 2010/0143033 A1 Jun. 10, 2010

Related U.S. Application Data

(62) Division of application No. 12/082,401, filed on Apr. 10, 2008, now Pat. No. 7,690,859, which is a division of application No. 11/376,282, filed on Mar. 15, 2006, now Pat. No. 7,374,362.

(51) Int. Cl.
*E01F 15/00* (2006.01)

(52) U.S. Cl. ..... 404/6; 404/10; 49/9; 49/34; 49/49; 244/110 C

(58) Field of Classification Search ..... 244/110 C, 244/110 R; 404/6, 10; 49/9, 34, 49; 256/13.1
See application file for complete search history.

(56) References Cited

U.S. PATENT DOCUMENTS

| | | | | |
|---|---|---|---|---|
| 1,628,651 | A | | 5/1927 | Burress |
| 1,848,516 | A | | 3/1932 | Davison |
| 1,848,517 | A | | 3/1932 | Davison |
| 2,237,106 | A | | 4/1941 | Minert |
| 2,712,912 | A | | 7/1955 | Hattan |
| 2,860,732 | A | * | 11/1958 | Snow ..... 244/110 A |
| 3,114,522 | A | * | 12/1963 | Mortimer ..... 244/110 A |
| 3,140,845 | A | * | 7/1964 | Cotton ..... 244/110 C |
| 3,179,358 | A | * | 4/1965 | Schlegel ..... 244/110 C |
| 3,182,935 | A | * | 5/1965 | Wischhoefer ..... 244/110 A |
| 3,366,353 | A | | 1/1968 | Jackson |
| 3,599,906 | A | * | 8/1971 | Reinemuth ..... 244/110 A |
| 3,620,489 | A | * | 11/1971 | Riblett, Jr. ..... 244/110 C |
| 4,576,507 | A | | 3/1986 | Terio |
| 4,611,794 | A | | 9/1986 | Taylor |
| 4,708,515 | A | | 11/1987 | Davies |
| 4,749,069 | A | | 6/1988 | Knecht et al. |
| 4,759,655 | A | | 7/1988 | Gorlov |
| 4,824,282 | A | | 4/1989 | Waldecker |
| 4,867,286 | A | | 9/1989 | Taylor |
| 5,009,542 | A | | 4/1991 | Hardin, Jr. et al. |
| 5,634,738 | A | | 6/1997 | Jackson et al. |
| 5,762,443 | A | | 6/1998 | Gelfand et al. |
| 5,823,705 | A | | 10/1998 | Jackson et al. |
| 5,993,104 | A | | 11/1999 | Marcotullio et al. |
| 6,216,831 | B1 | | 4/2001 | Taylor |
| 6,312,188 | B1 | | 11/2001 | Ousterhout et al. |

(Continued)

*Primary Examiner* — Gary S Hartmann
(74) *Attorney, Agent, or Firm* — Kenneth J. Lukacher

(57) ABSTRACT

In order to stop a moving vehicle without injury to occupants, a vehicle barrier is provided having a pair of platforms disposed on opposite sides of a roadway, and a capture net extending across the roadway between the platforms. Each platform has a rotatably mounted spool attached to a different end of the net, and a dual acting extension-compression shock absorber pivotally mounted to the spool, such that when the force or energy of an impacting vehicle on the net is applied to the shock absorbers, via rotation of the spools. Rotation of spools operate the shock absorbers in compression, and if needed, in extension. In railroad crossing application, two of the vehicle barriers are provided on either side of the railroad tracks to prevent vehicles from crossing the railroad tracks.

16 Claims, 11 Drawing Sheets

U.S. PATENT DOCUMENTS

| | | | | |
|---|---|---|---|---|
| 6,405,493 | B1 | 6/2002 | Taylor | |
| 6,640,941 | B2 | 11/2003 | Taylor | |
| 6,843,613 | B2 | 1/2005 | Gelfand et al. | |
| 6,845,589 | B1 * | 1/2005 | Thompson et al. | 49/49 |
| 7,195,419 | B2 | 3/2007 | Gelfand | |
| 7,207,370 | B2 | 4/2007 | Snyder et al. | |
| 7,237,591 | B2 | 7/2007 | Snyder et al. | |
| 7,374,362 | B1 | 5/2008 | Metzger | |
| 7,377,716 | B2 * | 5/2008 | Gelfand | 404/6 |
| 7,441,983 | B2 | 10/2008 | Gelfand | |
| 7,467,909 | B2 * | 12/2008 | Orner et al. | 404/6 |
| 7,641,416 | B2 * | 1/2010 | Miracle | 404/6 |
| 7,690,859 | B2 * | 4/2010 | Metzger | 404/6 |
| 7,785,031 | B2 * | 8/2010 | Vellozzi et al. | 404/6 |
| 2003/0016996 | A1 | 1/2003 | Gelfand et al. | |
| 2005/0117967 | A1 | 6/2005 | Gelfand | |
| 2005/0218391 | A1 | 10/2005 | Gelfand | |

* cited by examiner

VEHICLE BARRIER

This application is a divisional of U.S. patent application Ser. No. 12/082,401, filed Apr. 10, 2008, now U.S. Pat. No. 7,690,859, which is a divisional of U.S. patent application Ser. No. 11/376,282, filed Mar. 15, 2006, now U.S. Pat. No. 7,374,362.

FIELD OF THE INVENTION

The present invention relates to a vehicle barrier (and system and method) for absorbing energy of a moving vehicle in a captive net that stretches across a roadway, and particularly to a vehicle barrier in which the impact energy of the vehicle on the net is applied to shock absorbers via rotation of drums or spools coupled the ends of the net. Two of such vehicle barriers may be provided across a roadway on opposite sides of a railroad track to prevent vehicles from crossing the railroad track when a train is present. The invention may also be used in any other application to stop a moving vehicle, such as drawbridges, HOV traffic control, security gates, or crash cushion applications.

BACKGROUND OF THE INVENTION

The problem of vehicles improperly crossing railroad tracks is becoming more pronounced due to a rise in both the average speed of trains and in the number of vehicles on the roads. Traditional systems for preventing vehicles from crossing the tracks at inopportune times have proved less than fully satisfactory, and traditional gates can be bypassed by impatient drivers who do not yet see a train coming, and, in any event, will not stop a vehicle that is out of control.

Energy absorbing system have been developed for preventing vehicles from crossing a railroad track by automatically deploying a restraining barrier across a roadway adjacent to a railroad track upon an approaching train. For example, U.S. Pat. No. 5,762,443 describes a heavy-duty shock absorber system with two pairs of concrete bunkers on either side of a railroad track, and a retractable capture net extending across the roadway between each pair of bunkers. In each bunker, the net is coupled to two hydraulic shock absorber mounted in a rotatable structure about a stachion, i.e., a large concrete filled steel pipe embedded 4 feet deep in a concrete foundation and extending 5 to 6 about ground level. The shock absorbers each have a piston and a cylinder, and operate by compression of fluid by the piston being driven into the cylinder in response to vehicle impact on the net.

U.S. Pat. No. 6,843,613 and U.S. Published Patent Application No. 2003/0016996, published Jan. 23, 2003, describe another heavy duty shock absorber system also utilizing pairs of bunkers on either side of a railroad track and stachions, but has the advantage of mounting each pair of hydraulic shock absorber using rotational flanges to the stachions, thereby avoiding the large rotatable structure of U.S. Pat. No. 5,762,443 for orienting the shock absorbers for operation by compression. In each bunker, the net is coupled to two hydraulic shock absorbers that are in turn attached to a flange rotatable about the bunker's stachion. Each of the hydraulic shock absorbers operates by extension of their piston from an initial compressed position away from the cylinder in response to vehicle impact on the net.

U.S. Patent Publication No. 2005/0117967, published Oct. 6, 2005, describes a heavy duty shock absorber system similar to U.S. Pat. No. 6,843,613, but without bunkers in which the two hydraulic shock absorbers also operate in extension in response to vehicle impact on the net. Unlike U.S. Pat. No. 6,843,613, the shock absorbers are oriented perpendicular, rather than parallel, to the railroad track when no vehicle is present. The net is supported on either side of a roadway by pivotal supports that are rotatable to an upright position when the net is needed.

One major drawback of the vehicle energy absorbing systems describes in the above-cited U.S. Patents and Published Applications is that they require a large amount of square footage for installation along roadsides due to the large size of the shock absorbers required to absorb the momentum generated by a vehicle impacting the net. For example, the shock absorbers used in U.S. Patent Publication No. 2005/0117967 and U.S. Pat. No. 6,843,613 are 5-6 feet when compressed when no impact is present, and can extend 8-11 feet in response to impact. Thus, it would be desirable to reduce the size of shock absorbers used in these systems, while still providing the necessary energy absorption of an impacting vehicle. Such reduction in the overall size of the vehicle energy absorbing system can enable their installation along more railroad crossings where space about the roadside is limited. It would further be desirable if the stachions required in the above cited U.S. Patents and Published Applications were no longer required, thereby making installation easier and less costly.

SUMMARY OF THE INVENTION

It is one object of the present invention to provide a vehicle barrier for absorbing energy of a vehicle in a net that stretches across a roadway which is more compact than the prior art net-based vehicle barriers.

It is another object of the present invention to provide a vehicle barrier having two shock absorbers, one on each side of a net, in which such shock absorbers are operable in compression and extension.

It is a further object of the present invention to provide a vehicle barrier having two shock absorbers, one on each side of a net, in which such shock absorbers move between parallel and angled orientations which respect to the railroad tracks during their operation.

Briefly described, the vehicle barrier embodying the present invention has a pair of platforms disposed on opposite sides of a roadway, and a capture net extending across the roadway between the platforms. Each of the platforms has a rotatably mounted spool (or drum) attached to a different end of the net, and a shock absorber pivotally mounted to the rotatably mounted spool, in which the shock absorber absorbs the impact force of a vehicle upon the net when conveyed to the shock absorber via rotation of the spool.

The shock absorbers of each of the platforms preferably are dual acting extension-compression hydraulic shock absorbers. The shock absorbers are mounted to their respective spool such that applied force to the net by an impacting vehicle is transferred via rotation of the spools to their respective shock absorbers, in which such rotation first operates the shock absorbers in compression, and when additional energy absorption is needed to stop the vehicle operates their respective shock absorber in extension. Two posts on either side of the roadway may be provided for supporting cables from the ends of the net to the platforms. The post may be part of, or separate from, the platforms.

In railroad crossing application, two of the vehicle barriers are provided on either side of the railroad track to prevent vehicles from crossing the railroad track. Preferably, the support posts are part of a net lowering and raising mechanism in which support posts are mounted to the mechanism for pivoting each of the posts between up and down positions, thereby raising and lowering the net. The net may be stored when in a down position in depressions in the roadway surface for receiving the net. In this manner, the net may be placed in a down position when no train is present to permit vehicle traffic flow, and the net is then raised when a train is detected. The mechanism may be operable in response to a typical railing crossing train detection system.

BRIEF DESCRIPTION OF THE DRAWINGS

The foregoing objects, features and advantages of the invention will become more apparent from a reading of the following description in connection with the accompanying drawings in which:

FIGS. 3A, 3B, and 3C are perspective, plan, and side elevational views, respectively, of one of the platforms of FIG. 1 prior to an impact by a vehicle on the net, in which FIG. 3A is a perspective view from the reverse side of the perspective view of FIG. 1A;

DETAILED DESCRIPTION OF THE INVENTION

Figure 1:
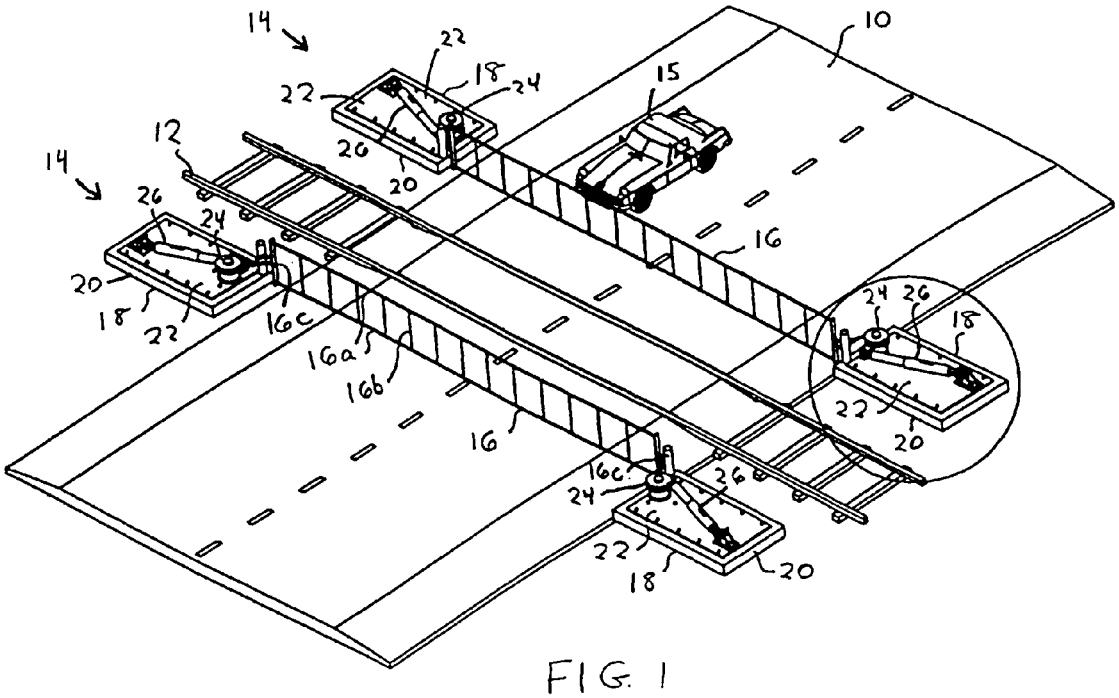
FIG. 1 is a perspective view which illustrates a railroad crossing for a roadway with two of the vehicle barriers according to the present application.
Figure 1A:
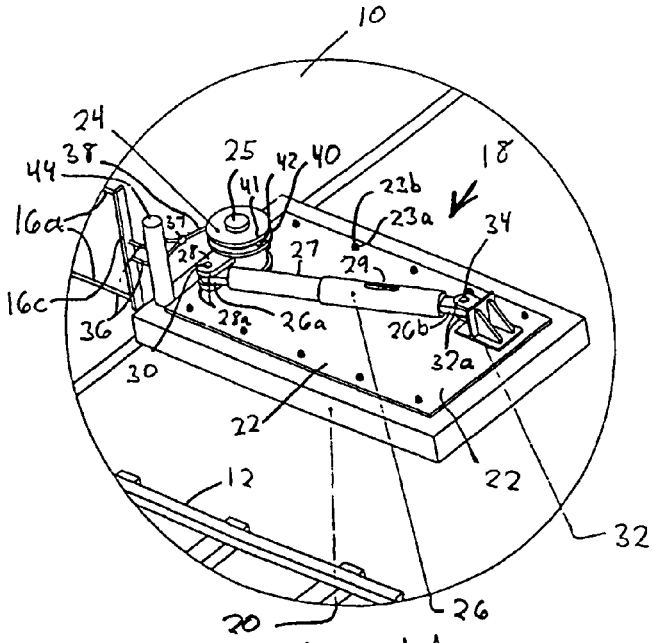
FIG. 1A is a more detailed view of the circled portion of FIG. 1 showing one of the pair of platforms of a vehicle barrier.
Figure 3A:
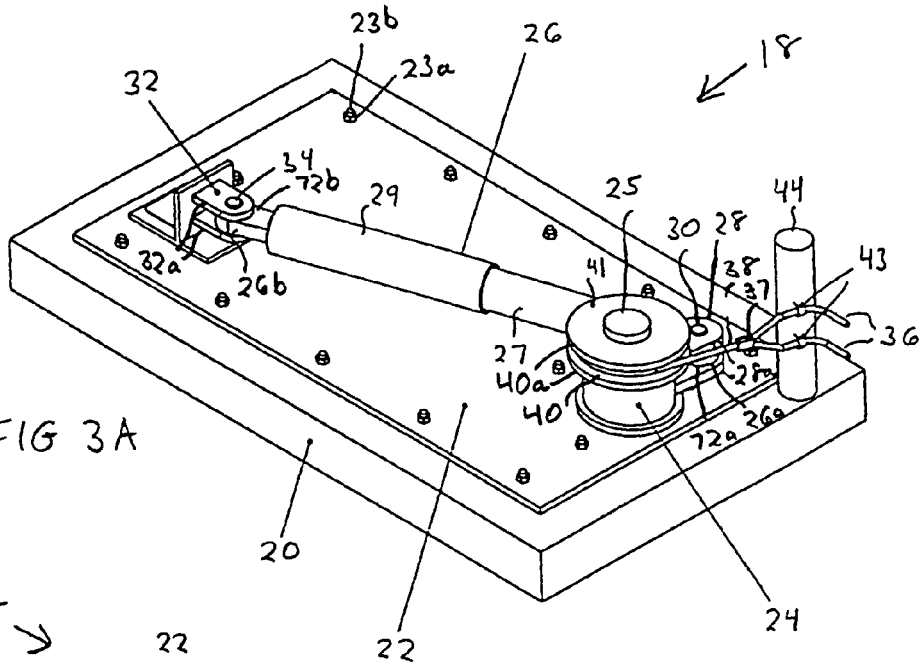
Figure 3B:
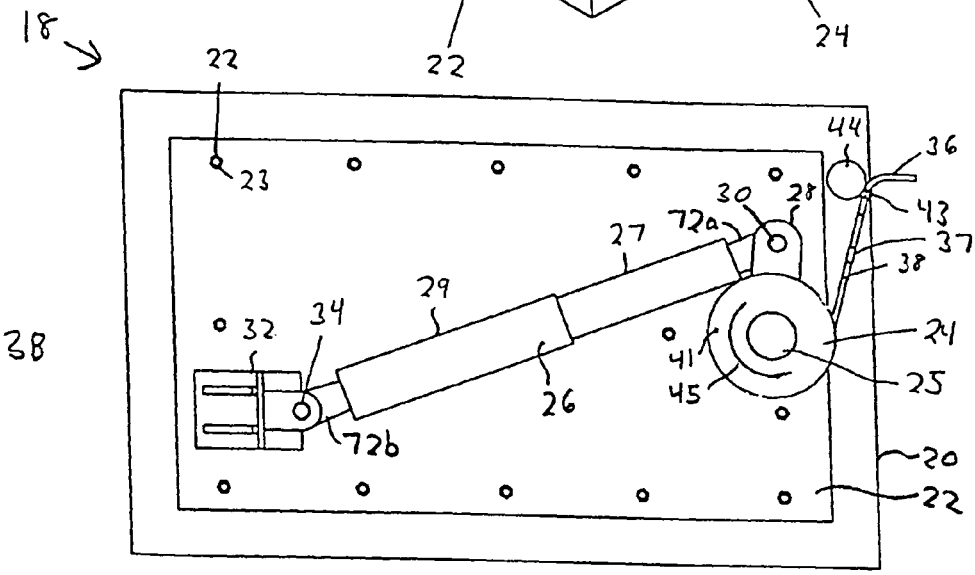
Figure 3C:
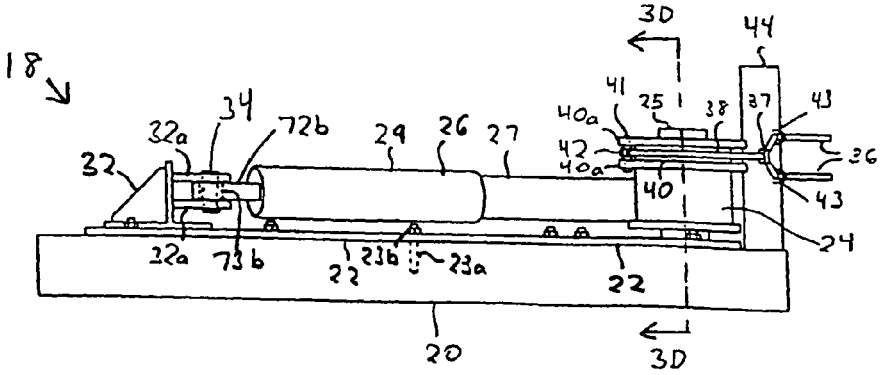
Figure 3D:
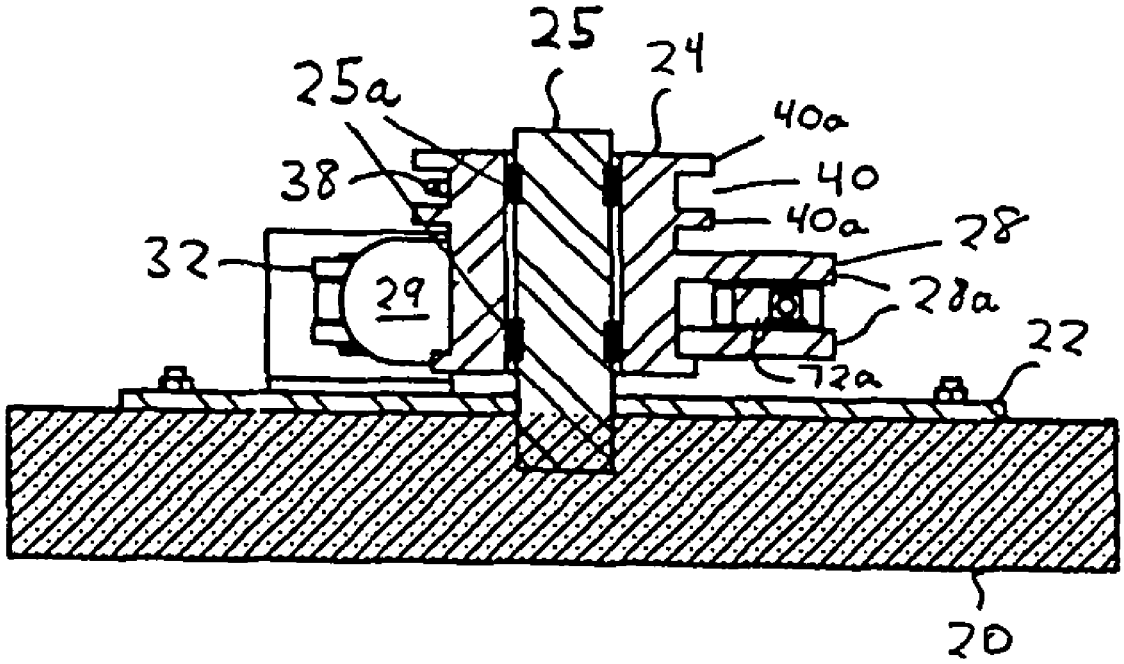
FIG. 3D is a cross-sectional view along lines 3D-3D of FIG. 3C.

Referring to FIG. 1, a typical railroad crossing for a roadway 10 is shown having two vehicle barriers 14 on opposite sides of railroad tracks 12. Each vehicle barrier 14 has a vehicle capture net 16 stretched across roadway 10 between a pair of platforms 18. Each platform has a rotatable spool or drum 24 attached by cables to a different end of the net 16, and a shock absorber 26 pivotally mounted to spool 24. The platforms 18 are identical, and a pair of platforms coupled to the same net 16 are in a mirrored orientation with respect to each other, as illustrated in FIG. 1. One of platforms 18 is shown in more detail in FIGS. 1A and 3A-3D when no impact by a vehicle on net 16 is present. Each platform 18 has a concrete pad 20 and a plate 22 attached to the pad. The plate 22 may be of stainless steel and attached to pad 20 by nuts 23*a* threaded onto anchor stubs 23*b* extending from the pad 20 through holes in plate 22. Spool 24 is rotationally mounted on a fixed post 25 extending from the concrete pad 20 through an opening in the plate 22. Bearings 25*a* may be present to facilitate rotation of the spool 24 about post 25, as shown in FIG. 3D. For example, the pad 20 may be 8 feet by 5 feet, and plate 22 may be 7 feet by four feet, but other dimensions may be used.

The shock absorber 26 of each platform 18 is a dual acting tension-compression hydraulic shock absorber having a cylinder 27 and a rod 46 (FIGS. 2B-D) having a piston head 48 (FIG. 2B-F) movable in the cylinder. Ends 26*a* and 26*b* of shock absorber 26 are coupled to cylinder 27 and rod 46, respectively. Rod 46 is hidden from view in FIG. 1A by a cylindrical sheath 29 which extends over the rod, and such sheath moves in concert with the rod, but over the outside of cylinder 27. A bracket 28 is attached, such as welded and/or bolted, to spool 24. End 26*a* of the shock absorber 26 is pivotally mounted to bracket 28 by a shaft 30 extending through holes in each of the two flanges 28*a* of the bracket 28 and through an opening 73*a* (FIG. 2B) extending through shock absorber end 26*a*. Another bracket 32 is attached, such as welded and/or bolted, to plate 22, and end 26*b* of the shock absorber 26 is pivotally mounted in bracket 32 by a shaft 34 extending through openings in each of the two flanges 32*a* of bracket 32 and through an opening 73*b* (FIG. 2B) through shock absorber end 26*b*.

The net 16 has a structure of a pair of horizontally extending cables 16*a* connected by a plurality of vertically extending cables 16*b*. Cables 16*a* and 16*b* may be galvanized structural strands with a minimum breaking strength sufficient to withstand the force of an impacting vehicle. Vertical cables 16*b* may be connected to horizontal cables 16*a* by clamps or sockets, and spacers (not shown) may be present along horizontal cables between adjacent vertical cables 16*b* if needed to maintain spacing between vertical cables. Although only two vertical cables are shown, additional vertical cables may be provided, and may have shaped structures. The net 16 may be the same or similar to the net described in U.S. Pat. Nos. 5,762,443 or 6,843,613, or U.S. Published Patent Application No. 2003/0016996.

At the two ends of net 16 are side members 16*c* attached to the first and last vertical cable 16*b* of the net. Extending from each of the side members 16*c* are two net end cables 36 which are joined, such as by a clamp 37, to a cable 38 that extends to the platforms 18 on either side of roadway 10. In each of these platforms, the cable 38 in received in a channel 40 extends along the outer circumference of the spool. The end of cable 38 is captured by a swivel socket 42 and a shaft 41 extends through a hole in the socket and holes in two flanges 40*a* defining the top and bottom walls of channel 40, such that end of cable 38 can swivel about shaft 41. Other attachment mechanisms may be used for coupling end of cable 38 to spool 24 so long as the tension conveyed to cable 36, via cables 38, will rotate the spool when a vehicle impacts the net.

When no impact is present, such tension is applied to maintain the net taught between net side members 16*c*, but without initiating rotation of the spool 24.

Figure 2A:
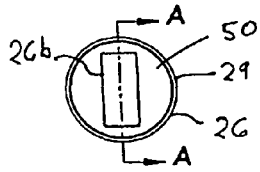
FIG. 2A is an end view of one of the dual acting extension-compression hydraulic shock absorbers of FIG. 1.
Figure 2B:
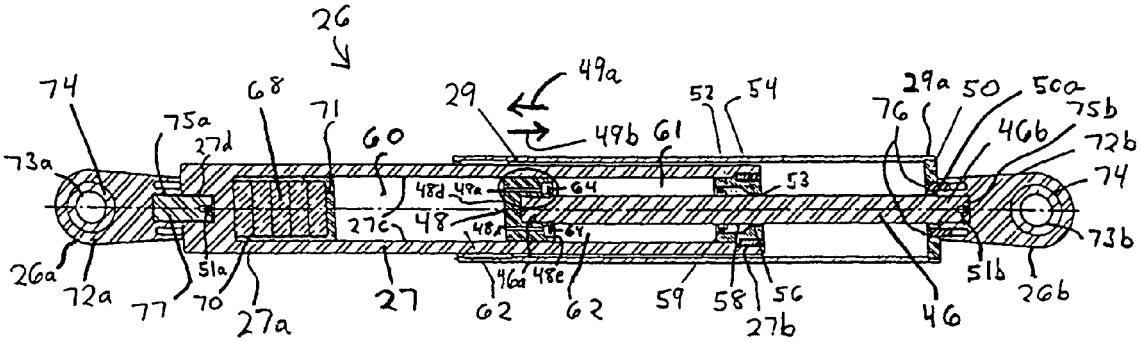
FIG. 2B is a cross-sectional view along lines A-A of FIG. 2A in which the shock absorber is shown about midway between full extension and compression.
Figure 2E:
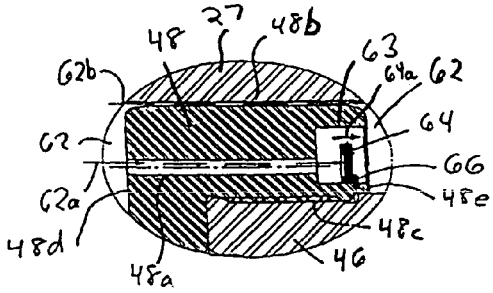
FIGS. 2E and 2F are more detailed views of a portion of the piston head along the circle portion of FIG. 2B during compression and extension, respectively.
Figure 2F:
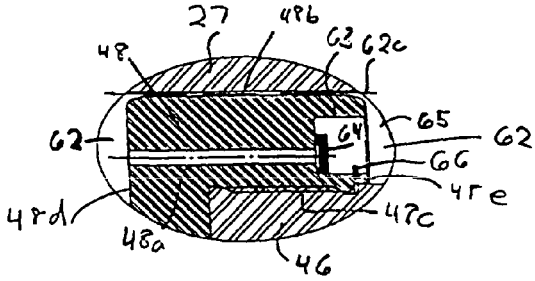

Each pair of platforms 18 has a fixed post 44 extending from concrete pad 20. Each pair of net end cables 36 each extend through breakaway brackets 43 attached to the post 44 prior to joining cable 38 to each of the platforms 18 associated with the net. A rotational force in the direction of arrow 45 (FIG. 3B) on spool 24 will occur when cables 36 and 38 at the ends of the net are pulled due to impact of a vehicle on net 16, as will be shown below, such the impact force or energy is dampened by shock absorbers 26 operable first is a compression mode, and if needed in an extension mode Referring to FIGS. 2A-2G, the hydraulic shock absorber 26 of each platform 18 is shown in more detail. One end 46*a* of the rod 46 is attached to piston head 48, such end 46*a* being threaded to screw into a threaded bore 47 of the piston head 48, so as to be movable within the cylinder between full compressed position, shown in FIG. 2C, and full extended position shown in FIG. 2D. Arrows 49*a* and 49*b* illustrate the direction of movement of the rod 46 with respect to the cylinder 27 when operating in compression and extension modes, respectively. The overlap of the threads of rod end 46*a* and piston head 48 is denoted by 48*c* (FIGS. 2E and 2F).

To couple the cylindrical sleeve 29 to rod 46, the end 29*a* of sleeve 29 is attached, such as welded, to a sleeve adapter 50, and rod end 46*b* is threaded, and extends through opening 50*a* of the sleeve adapter 50, and screwed into a threaded bore 75*b* of a clevis 72*b*. Clevis 72*b* is attached by screws or bolts 76 to sleeve adapter 50.

Figure 2C:
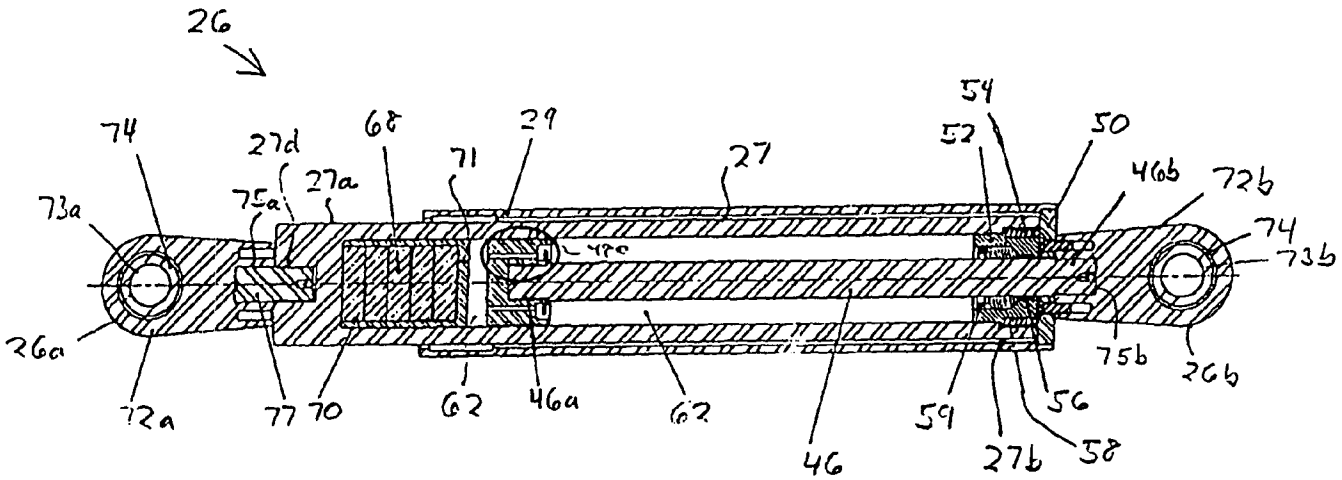
FIGS. 2C and 2D are cross-sectional views similar to FIG. 2B in which the shock absorber is shown in full compression and full extension, respectively.
Figure 2D:
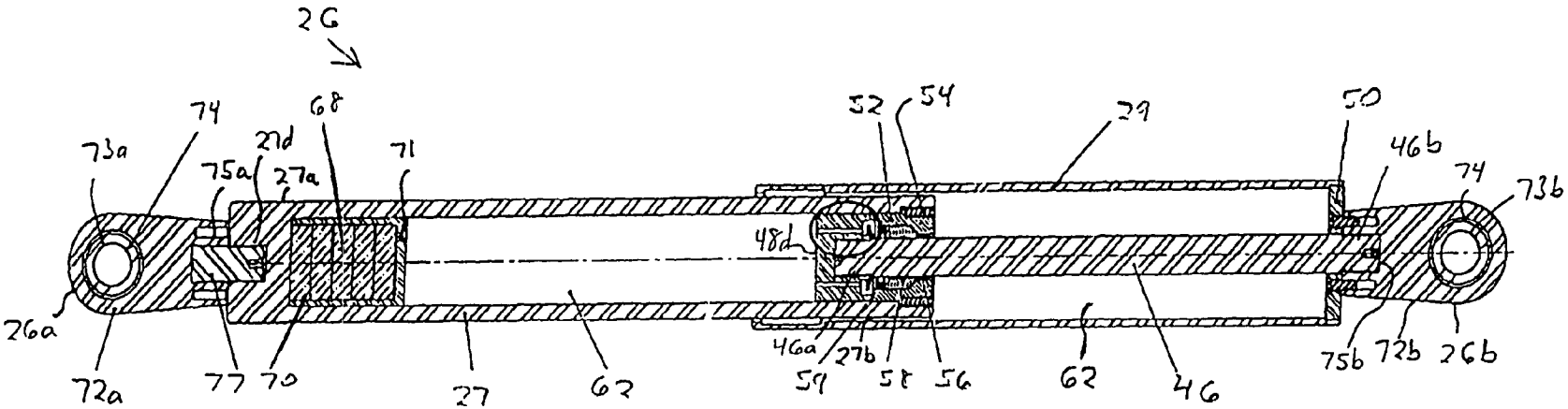
Figure 2G:
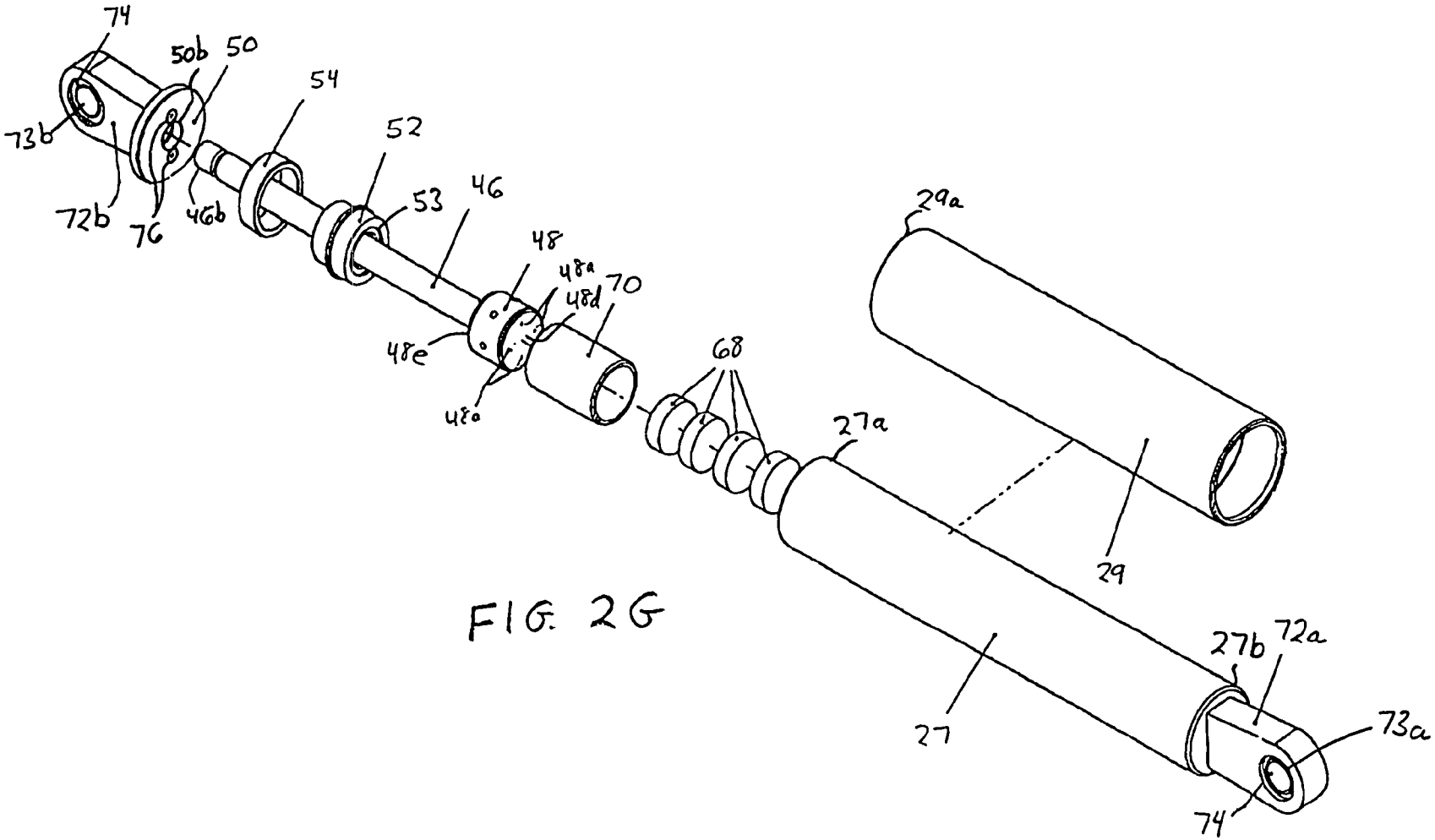
FIG. 2G is an exploded view of one of the shock absorbers of FIG. 1.

At the shock absorber end 26*a*, the ends 27*a* of the cylinder 27 is coupled to another clevis 72*a* by a threaded plug 77 screwed into threaded bore 75*a* of clevis 72*a* and then into threaded bore 27*d* of the cylinder. Each end 26*a* and 26*b* has a hex broach 51*a* and 51*b* (FIG. 2A), respectively, by which an Allen wrench may be used to tighten parts together. Each of the clevises 72*a* and 72*b* have an opening 73*a* and 73*b*, respectively, having spherical bearings 74. Openings 73*a* and 73*b*, for example, may each be 2 inches in diameter. Such bearings facilitate pivoting of shock absorber ends 26*a* and 26*b* along shafts 30 and 34 (FIG. 1A), respectively, through brackets 28 and 32, respectively. The rod 46 and piston head 48 may be made of stainless steel, and the cylinder 27 and cylindrical sleeve 29 may be of stainless steel, or plated steel. For example the dimensions may be as follows: the shock absorber 26 may be 66 inches in length when fully extended, as shown in FIG. 2D, between the centers of openings 73*a* and 73*b*; rod 46 and piston head 48 when assembled may be 28⅝ inches in length from rod end 46*b* to front face 48*d* of piston head 48; sleeve 29 may be 29⅞ inches long and have an interior diameter of 6¾ inches; and cylinder 27 may have an outer diameter of 5⅝ inches. Other dimensions may also be used.

The end 27*b* of cylinder is closed by a cylinder cap 52, which has a central opening 53 through which the rod 46 can retract and extend. A cap nut 54 is screwed onto a threaded annular recess at cylinder end 27*b* to retain cap 52. A guide ring 56 is positioned in cap 52 at one end of opening 53, and the other end of the opening 53 is sized for insertion of a sealing member 58 and a ring 59 for retaining the sealing member 58 in cap 53. The sealing member 58 may be of carbon steel ring press fit into cap opening 53.

Opposite sides of the piston head 48 forms two chambers 60 and 61 in the cylinder 27, and a fluid 62, such as liquid silicone, is provided that can flow between the chambers in response to movement of piston head 48 in the directions of arrow 49*a* or 49*b*. The fluid 62 is sealed in cylinder 27 by cap 28, ring 59, and sealing member 58. The flow of fluid 62 is best shown in FIGS. 2E and 2F. The piston head 48 has a number of drilled inner channels (or ports) 48*a* (e.g., between 1 to 10 inner channels) extending from its back face 48*d* through the piston head to its front face 48*e*. An outer annular channel or gap 48*b* is defined by the outer surface of the piston head 48 and the inner surface 27*c* of the cylinder 27. Each of the inner channels 48*a* extends through piston head 48 from chamber 60 to chamber 61 into an annular chamber 63 along back face 48*d*. Annular chamber 63 has a movable ring flapper valve 64, which is retained in chamber 63 by a fixed retaining ring 66, while being movable in chamber 63 towards and away from channels 48*a* in response to the direction of fluid flow between chambers 60 and 61. When the shock absorber 26 operates in a compression mode, the rod 46 and its piston head 48 are driven into the cylinder 27 (as indicated by arrow 49*a*), the piston head 48 moves along inner surface 27*c* of the cylinder 27 and its front face 48*c* forces fluid 62 to flow from chamber 60 to chamber 61 through inner channels 48*a* (as illustrated by arrow 62*a*), where the flapper value 64 is pushed by such flow (as indicated by arrow 64*a*) towards the retaining ring 66, and fluid 62 to move from chamber 60 to chamber 61 around the piston head 48 through gap 48*b* (as illustrated by arrows 62*b*), until full compression is reached (FIG. 2C). When the shock absorber 26 operates in an extension mode, the rod 46 and its piston head 48 are driven away from the cylinder 27 (as indicated by arrow 49*b*) and the piston head's back face 48*d* forces fluid 62 to flow from chamber 61 to chamber 60, but only around the piston head 48 through outer gap 48*b*, as illustrated by arrow 62*c* (FIG. 2F), since the inner channel 48*a* is closed (or substantially closed) due to the flow pushing the flapper value 64 against inner channels 48*a*, until full extension is reached (FIG. 2D).

The reduced fluid flow by closure of the inner channels 48*a* during extension results in the stroke of the shock absorber 26 being stiffer in extension than compression. This double acting shock absorber can be half the length of a conventional shock absorber operable in a single compression or extension mode, and the different stiffness of the extension stroke has advantages is stopping a moving vehicle, as will be shown below. In FIG. 2B, the shock absorber is shown at a mid position between full compression and extension.

Within the closed end 27*a* of the cylinder 27 is an accumulator 68 mounted in a can 70 having wall abutting the inner surface of the cylinder 27. The accumulator 68 may be of foam blocks, and the wall of the can 70 facing piston head 48 has a small orifice 71. When the piston head 48 is pushed to its full extent into cylinder 27, as shown in FIG. 2C, fluid 62 can pass to the accumulator 68 through this orifice 71.

Abutment of the sleeve adapter 50 to cylinder end 27*a* defines the full compression of the rod 46 and its piston head 48 into the cylinder 27 (FIG. 2C). Abutment of the piston head 48 against the cylinder cap 52 defines the full extension of rod 46 from the cylinder (FIG. 2D). The shock absorbers 26 are shown in full extension in FIG. 1, as well as in FIGS. 1A and 3A-3C.

Figure 4A:
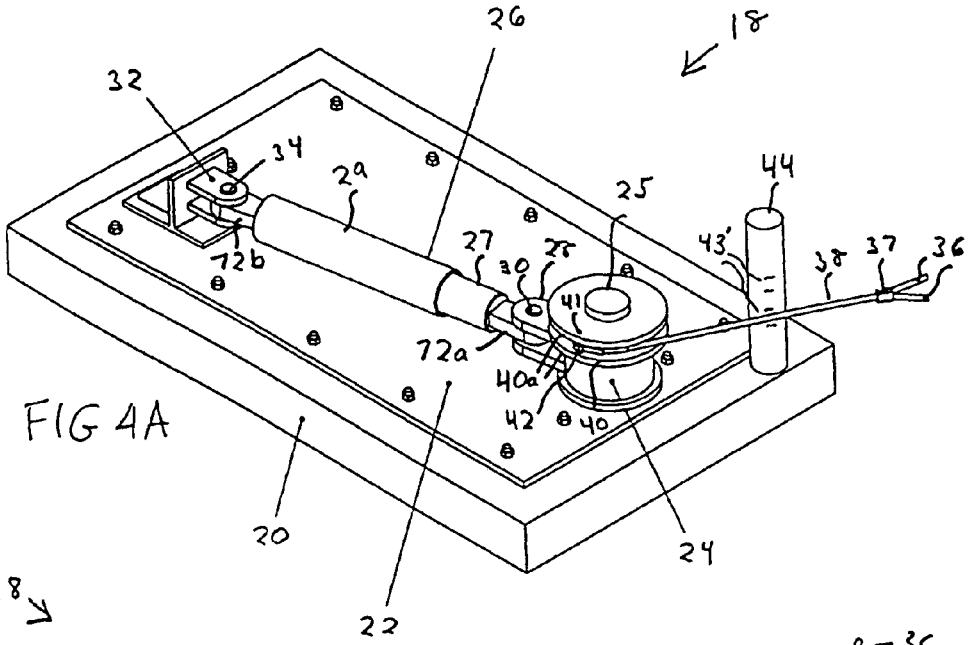
FIGS. 4A, 4B, and 4C are perspective, plan, and side elevational views, respectively, similar to FIGS. 3A-3C, respectively, showing the platform during initial impact of force by a vehicle on the net and operation of the shock absorber and the spool attached to the net in response to the impact.
Figure 4B:
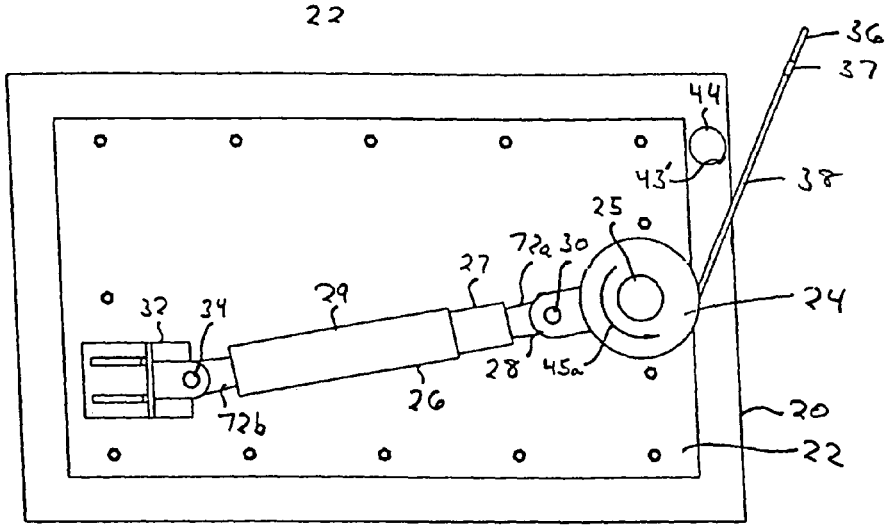
Figure 4C:
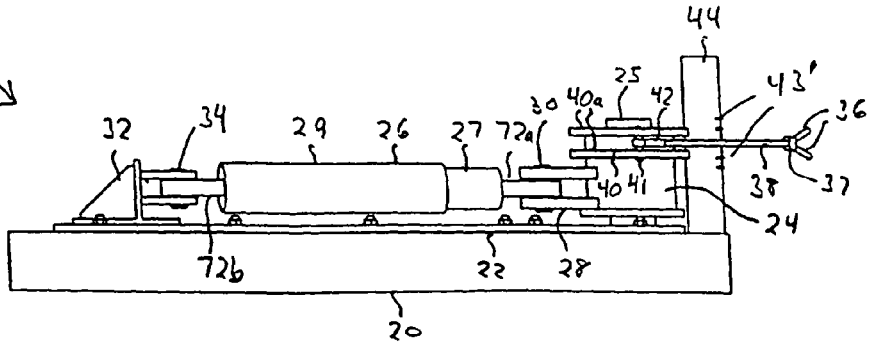

Prior to impact by a vehicle 15 on net 16, the pair of platforms between net 16 have their shock absorbers 26 at their full extended position and are disposed between brackets 28 and 32 at an angle (e.g., approximately 45 degrees) with the railroad track 12 and roadway 10, as shown in FIGS. 1, 1A, and 3A-3C. When a vehicle impacts the net 16, the applied force on the net 16 rotates the spool 24 (as shown by arrow 45*a*) along a first degree (e.g., up to 90 degrees), as shown in FIGS. 4A-4C. This breaks away the cables 36 from break away brackets 43 of post 44 of each of the platforms 18, in which brackets 43 have tension and fragility properties enabling such break away response. The broken brackets are indicated by reference number 43'. The shock absorber 26 of each platform 18 pivots about its end 26*a* in bracket 28 attached to spool 24 which pushes rod 46 into cylinder 27 of the shock absorber, thereby operating the shock absorber in compression. This dampens the force (energy) applied to the net by the impact, which for a light vehicle impact may not require full compression via rotation of the spool. If needed to further absorb the impact energy, the spool 24 continues to rotate (as shown by arrow 45*b*) a second degree (e.g., up to another 90 degrees) in response to any additional applied force (energy of the impact), which pivots the shock absorber at its end 26*a* in bracket 28 pulling the rod 46 away from the cylinder 27 of the shock absorber, thereby operating the shock absorber in extension (or tension). This further dampens the force applied to the net which, if needed for a heavy or high momentum vehicle, such as a truck, may require full extension of the shock absorber. The end 26*b* of the shock absorbers 26 also pivots in bracket 32 to facilitate pivotal motion of end 26*a* in bracket 28. The shock absorber 26 with the rod fully extended is approximately parallel with the long side of the railroad tracks 12, and hence substantially perpendicular to the sides of roadway 10. Thus, the impact force or energy of the vehicle is absorbed by shock absorbers 26 in the pair of platforms 18 coupled to the net 16, thereby lessening adverse effects of the impact forces acting on vehicle and its occupants and preventing encroachment of the vehicle onto tracks 12 when a train passes through.

Figure 6:
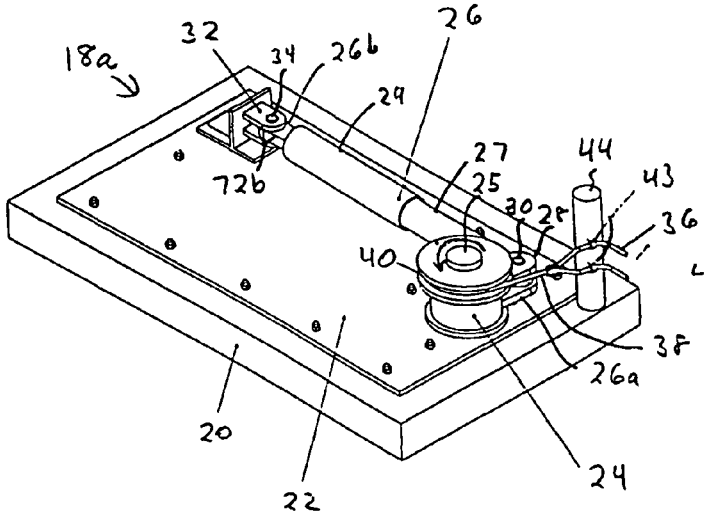
FIGS. 6, 7 and 8 are perspective views of another embodiment of one of the platforms which may be used in FIG. 1 showing the shock absorber at different angular orientation than FIGS. 3A-3C, where the platform is shown in FIG. 6 prior to an impact by a vehicle on the net, in FIG. 7 shows the platform during initial impact, and in FIG. 8 when more dampening is required, respectively.
Figure 7:
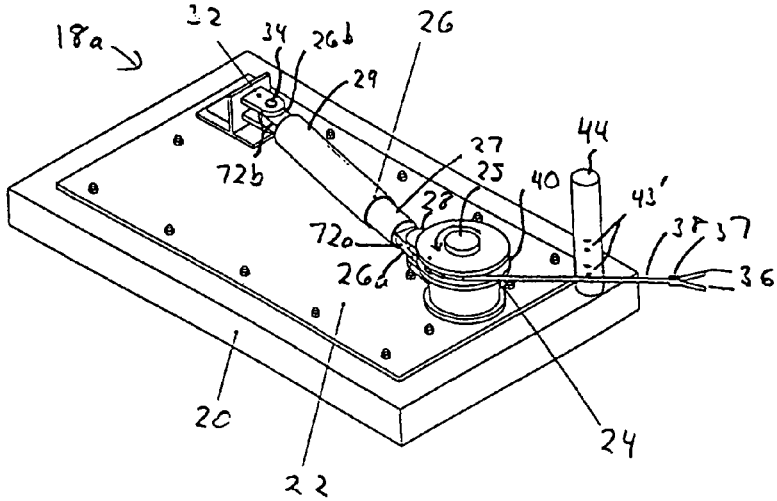
Figure 8:
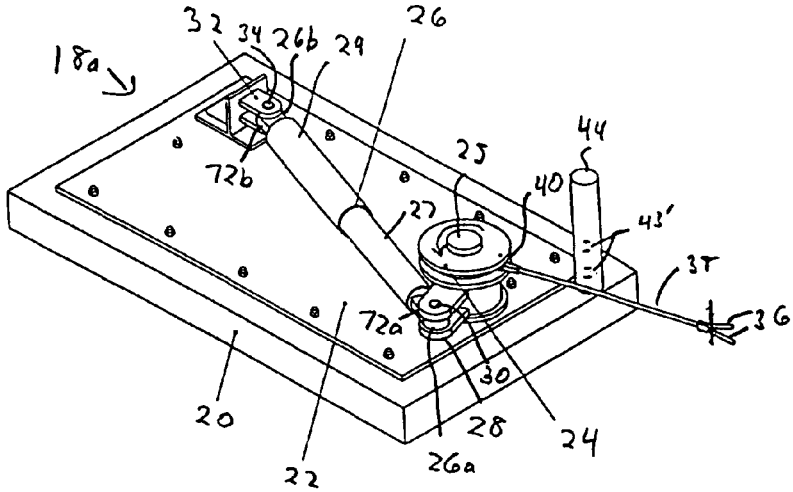

Referring to FIGS. 6-8, one of the platforms of another embodiment of platforms 18 is denoted by reference numeral 18*a*. Like numbers reference the same elements as in other figures. The only difference in platform 18 is that the shock absorbers 26 in the vehicle barrier 14 are shown in another orientation with respect to the spools 24. In this orientation, the shock absorbers 26 are in full extension approximately parallel with the railroad tracks 12 and substituted perpendicular to roadway 10 prior to impact of a vehicle on the net (FIG. 6). The shock absorber 26 in response to impact on the net by the vehicle rotates the spool 24 pivot to operates the shock absorber in compression (FIG. 7), and then in extension (FIG. 8) in the same manner as described above, wherein full extension the shock absorbers 26 are at an angle (e.g., approximately 45 degrees) with respect to the railroad tracks 12 or roadway 10.

Figure 5A:
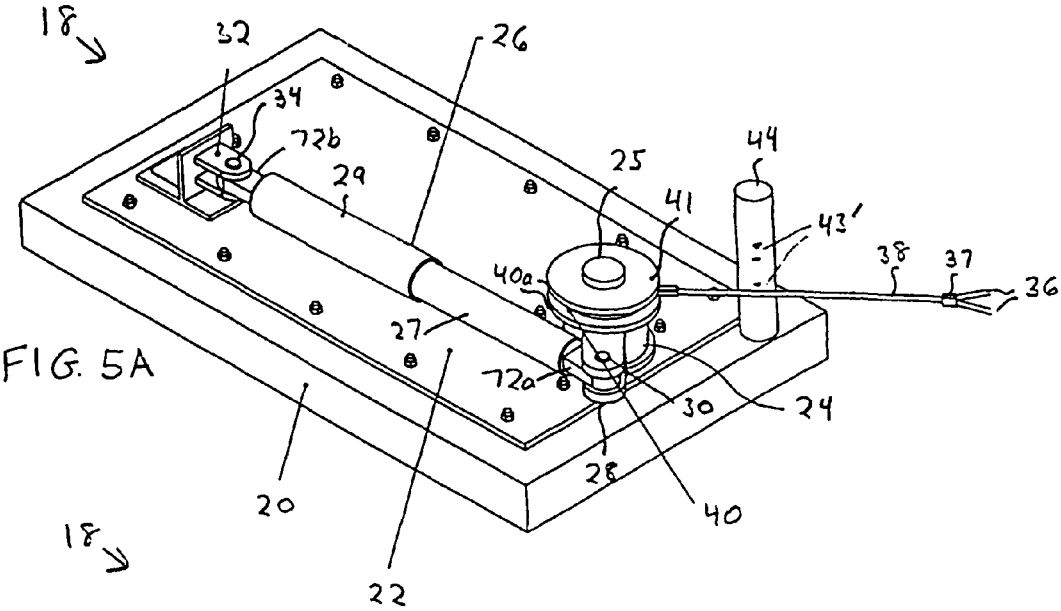
FIGS. 5A, 5B, and 5C are perspective, plan, and side elevational views, respectively, similar to FIGS. 3A-3C, respectively, showing the platform when additional impact of force by a vehicle on the net requires more dampening than that illustrated in FIGS. 4A-4C.
Figure 5B:
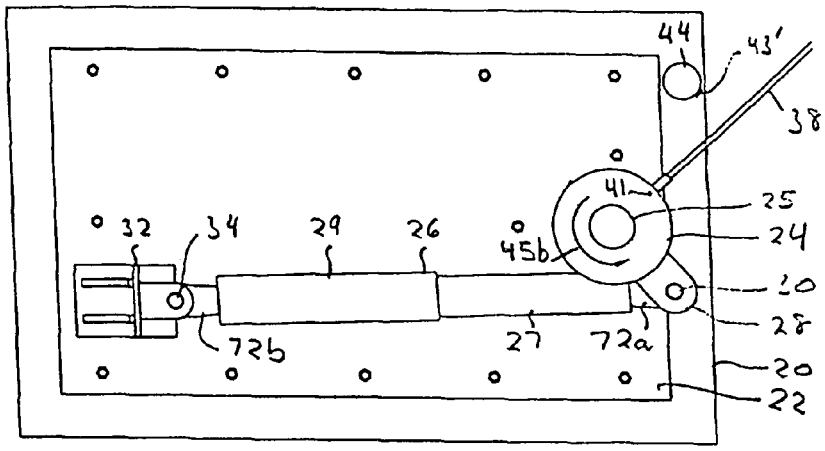
Figure 5C:
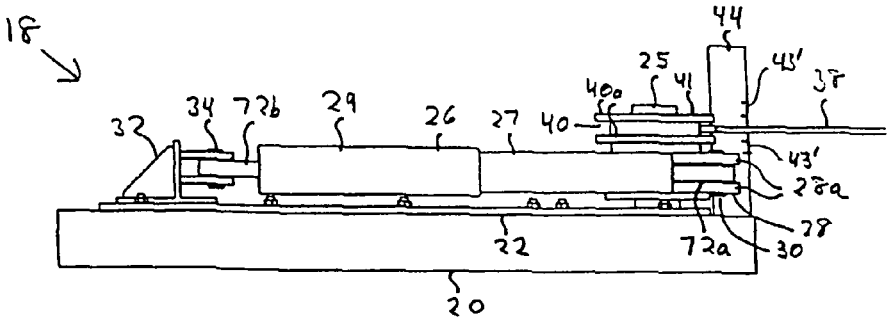
Figure 9:
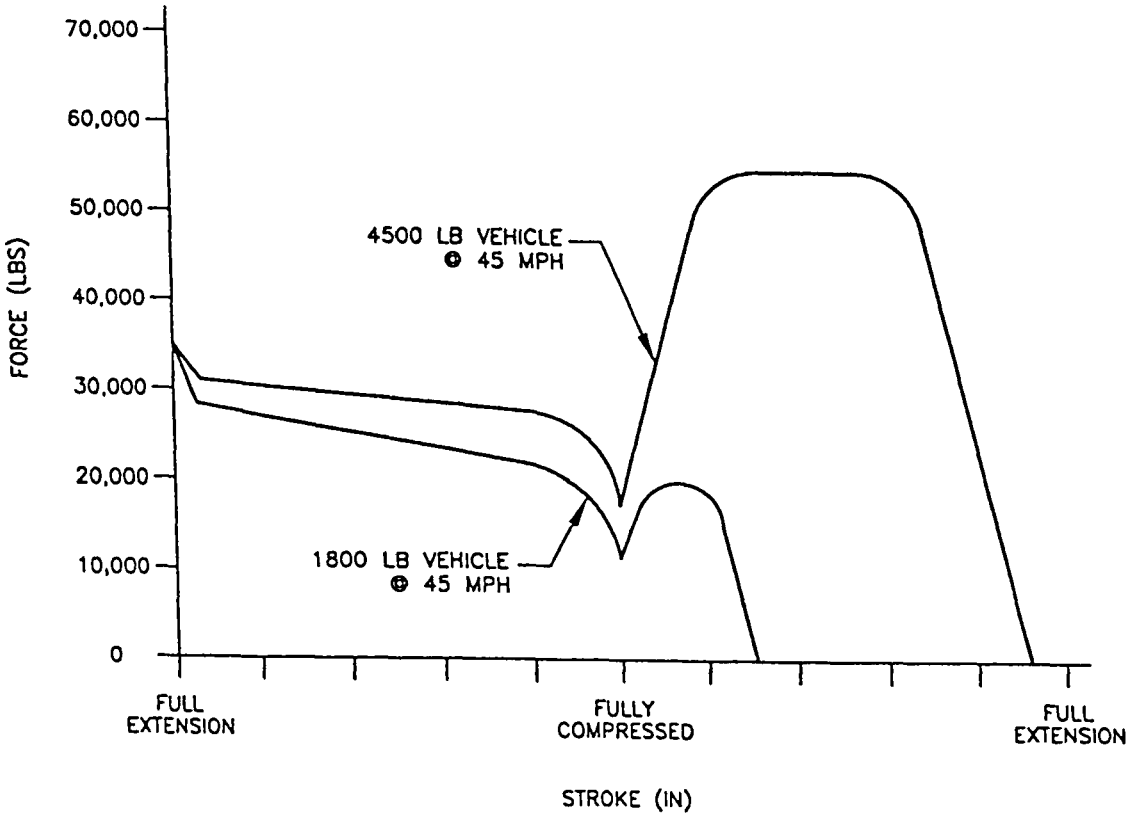
FIG. 9 is a graph showing the stroke of each of the shock absorbers in response to applied force on the net of the vehicle barrier of the present invention for two different weight vehicles.

FIG. 9 is a graph showing the stroke of each of the two shock absorbers 26 of platform 18 in response to applied force on the net 16 for two vehicles of different weight. The lower line illustrates the example of an 1800 lb vehicle traveling at 45 MPH crashing in net 16. The force or energy applied to the net is almost fully dampened by the shock absorbers operating in full compression (FIG. 4A-C) from their initial full extended position (FIGS. 3A-C), and needs only partial extension to fully stop the vehicle. The upper line illustrates the example of a 4500 lb vehicle crashing into net 16 at 45 MPH in which full compression (FIGS. 4A-C) of the shock absorbers first occurs, and then almost full extension (FIG. 5A-C) is needed to fully stop the vehicle. As the heavier vehicle illustrates, the stiffer stroke of the shock absorbers in extension enable stopping of vehicles applying up to 50,000 lbs of force on the captive net. The dampening functions shown in FIG. 9 will differ in the case of FIGS. 6-8, but will have similar different energy dampening characteristics in extension than compression due to the stiffer extension stroke.

Once the vehicle barrier has been used to capture a vehicle, such as one about to crash into a moving train, the vehicle barrier can be reset to that shown in FIG. 1 by removal of the vehicle from the net, reversing rotation of spools 24, and placement of cables 36 through replaced breakaway brackets 43 on posts 44.

Figure 10:
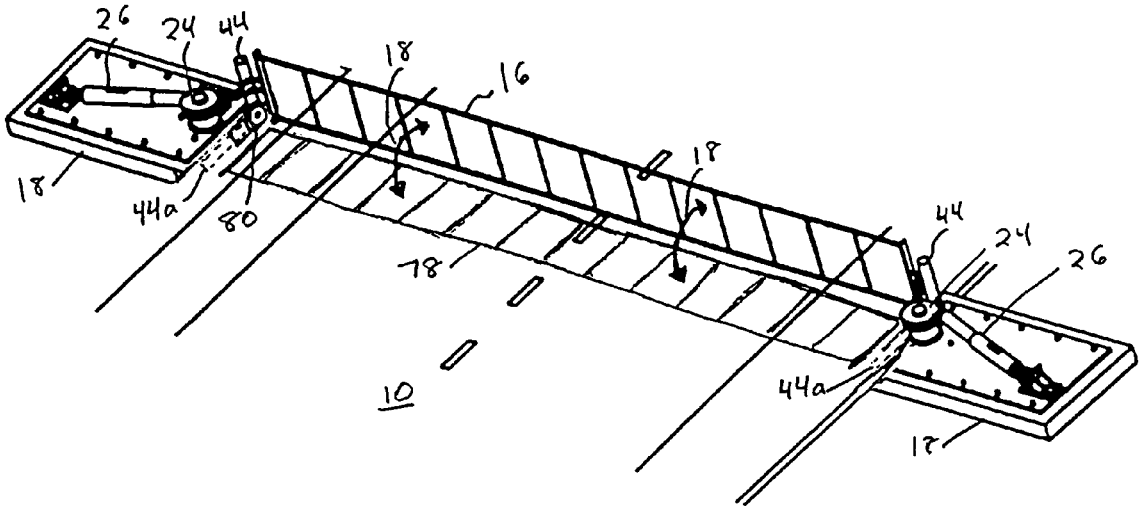
FIG. 10 is a perspective view of the net extending between a pair of platforms of FIG. 1, in which the net is pivotal between up and down positions.

Preferably, the net 16 is present across the roadway 10 when a train is detected by typical train detection system, such as commonly used to control gates at railroad crossings, and otherwise is lowered to allow vehicles to cross the railroad tracks 12. The net 16 may be raised and lowered as shown in FIG. 10 from it upright position to a down position for storage in a recessed grid 78 in the roadway surface 10 shaped for receiving the net. In this embodiment, the posts 44 are not fixed in pad 20, rather each of the posts 44 are attached to a motor driven actuator 80. Normally, the posts 44 are is down position as illustrated by dashed lines 44*a* locating the net 16 and grid 78. When a train is detected by typical train detection system, in addition to flowing gates (not shown) or initiating flashing lights (not shown) typically used, signals to the motor driven actuators 80 pivot the post 44 upward to their upright position. After the train is no longer detected, signals to the motor driven actuators 80 pivot the post 44 back down to its recess location in the roadway 10. Arrows 82 illustrate the pivotal motion of the net 16 between up and down positions. Optionally, springs may be provided which compress when the posts 44 is down to facilitate upward force on posts 44. Other devices for raising and lowering a net may also be used, such as the spring-based systems described in U.S. Patent Publication No. 2005/0117967, published Oct. 6, 2005. In other applications, the net lowering or raising of the mechanism provided by actuators 80 to each posts 44 may be raised or lowered by security personnel, e.g., via switch, button, or other wired or wireless signaling device, to control signals to each actuator 80.

Other shock absorbers may also be used than the dual acting shock absorbers described above. For example, the liquid spring unit of U.S. Pat. No. 4,611,794 may be used by providing channels or ports in and around a piston head enabling the response illustrated in FIG. 9. Although less preferably due to their large size, the shock absorbers operable from an extended state to a compressed state, such as those similar to those of U.S. Patent Publication No. 2005/0117967 and U.S. Pat. No. 6,843,613, may be used by their mounting to a accommodating pad 22 and to spool 24 similar in the manner of shock absorber 26 for pivotal movement in response to rotation of spool 24 in each pair of platforms 18 for the same net 16.

Although described for capturing a moving vehicle, such as a car or truck, the vehicle barrier of the present invention may be used at the end of a runway to stop an errant moving airplane.

From the foregoing description, it will be apparent that an improved vehicle barrier for absorbing energy of a vehicle in a net that stretches across a roadway has been provided. Variations and modifications of the herein described system and other applications for the invention will undoubtedly suggest themselves to those skilled in the art. Accordingly, the foregoing description should be taken as illustrative and not in a limiting sense.

The invention claimed is:

1. A system for absorbing energy comprising:

a rotatable spool; and a shock absorber having two ends movable with respect to each other, a first of said ends being pivotable about a fixed position and a second of said ends being mounted to said spool to enable said shock absorber to substantially pivot about said fixed position with rotation of said spool to effect movement of said second of said ends with respect to said first of said ends to absorb energy transferred by rotation of from said spool to the shock absorber.

2. The system according to claim 1 wherein said shock absorber movement of said first of said ends with respect to said second of said ends of the shock absorber is one of toward each other or away from each other.

3. The system according to claim 1 wherein said shock absorber movement of said first of said ends with respect to said second of said ends of the shock absorber towards each other operates the shock absorber in an energy absorbing mode.

4. The system according to claim 1 wherein said shock absorber movement of said first of said ends with respect to said second of said ends of the shock absorber away from each other operates the shock absorber in an energy absorbing mode.

5. The system according to claim 1 wherein said shock absorber is dual acting extension-compression shock absorber, in which movement of said first of said ends with respect to a second of said ends in a first direction operates the shock absorber in compression, and movement of said first of said ends with respect to said second of said ends in a second direction opposite said first direction operates said shock absorber in extension, in which rotation of said second of said ends with the spool is capable of moving said first of said ends with respect to said second of said ends in each of said first and second directions.

6. The system according to claim 5 wherein said dual acting extension-compression shock absorber provides energy dampening that is different in extension than compression operation.

7. The system according to claim 1 wherein said shock absorber is a shock absorber operable only in compression.

8. The system according to claim 1 wherein said spool is coupled to rotate in response to impact of a moving object on a net coupled by a cable to said spool.

9. The system according to claim 1 further comprising a surface onto which said spool is rotatably mounted and said second of said ends being pivotable about a fixed position with respect to said surface.

10. The system according to claim 9 wherein said surface is part of a platform.

11. An apparatus for absorbing energy comprising:

first means coupled to a cable at least partially wound on said first means and said first means being at least partially rotatable in response to tension applied by said cable;

second means for absorbing energy having two ends movable with respect to each other;

third means for pivotably mounting a first of said ends of said second means with respect to a fixed position; and fourth means for mounting a second of said ends of said second means to said first means to enable said second means to substantially pivot about said fixed position with rotation of said first means to effect movement of said second of said ends with respect to said first of said ends to absorb energy transferred by rotation of said first means to said second means.

12. The apparatus according to claim 11 wherein said second means movement of said first of said ends with respect to said second of said ends is one of toward each other or away from each other.

13. The apparatus according to claim 11 wherein said second means movement of said first of said ends with respect to said second of said ends of the second means towards each other operates the second means in an energy absorbing mode.

14. The apparatus according to claim 11 wherein said second means movement of said first of said ends with respect to said second of said ends of the second means away from each other operates the second means in an energy absorbing mode.

15. The apparatus according to claim 11 wherein said movement of said first of said ends with respect to a second of said ends in a first direction operates said second means in a first energy absorbing mode, and movement of said first of said ends with respect to said second of said ends in a second direction opposite said first direction operates said second means in a second energy absorbing mode, in which rotation of said second of said ends with the first means is capable of first moving said first of said ends with respect to said second of said ends in said first direction and then in said second direction.

16. The apparatus according to claim 11 wherein said cable has two ends and one of said end is coupled to said first means, and said apparatus further comprises fifth means, coupled to the other end of said cable, for receiving the impact by a moving object, in which said first means rotates in response to impact of said moving object by said fifth means applying tension to said cable.

* * * * *